US005657584A

United States Patent [19]

Hamlin

[11] Patent Number: 5,657,584

[45] Date of Patent: Aug. 19, 1997

[54] CONCENTRIC JOINT MECHANISM

[75] Inventor: Gregory J. Hamlin, Troy, N.Y.

[73] Assignee: Rensselaer Polytechnic Institute, Troy, N.Y.

[21] Appl. No.: 505,877

[22] Filed: Jul. 24, 1995

[51] Int. Cl.[6] ..... E04B 1/343

[52] U.S. Cl. ..... 52/81.3; 52/109; 52/646; 135/25.2; 135/27; 248/277.1; 248/421; 403/64; 403/171; 403/217; 403/218

[58] Field of Search ..... 52/109, 81.3, 646; 403/64, 170, 171, 217, 218; 248/277.1, 421; 135/25.2, 27, 98, 100, 20.1, 22

[56] References Cited

U.S. PATENT DOCUMENTS

| | | | |
|---|---|---|---|
| Re. 31,565 | 4/1984 | Beaulieu | 248/277.1 X |
| 771,575 | 10/1904 | Richardson | 248/281.11 |
| 990,399 | 4/1911 | Smith | 248/277.1 |
| 1,076,310 | 10/1913 | Pennington | 135/145 |
| 1,109,038 | 9/1914 | Burns | 248/277.1 |
| 1,335,230 | 3/1920 | Gleeson | 135/145 |
| 3,053,351 | 9/1962 | Fulcher | 189/2 |
| 3,877,544 | 4/1975 | McCollum | 52/109 X |
| 3,968,808 | 7/1976 | Zeigler | 135/145 |
| 4,450,851 | 5/1984 | Beavers | 135/109 |
| 4,480,418 | 11/1984 | Ventrella | 52/648 |
| 4,521,998 | 6/1985 | DeLorme | 52/81 |
| 4,684,088 | 8/1987 | Heller | 248/123.1 |
| 5,014,953 | 5/1991 | Warnan et al. | 248/284 |
| 5,024,031 | 6/1991 | Hoberman | 52/109 X |
| 5,167,100 | 12/1992 | Krishnapillai | 135/145 X |
| 5,290,050 | 3/1994 | Kim | 52/109 X |
| 5,292,118 | 3/1994 | Allen et al. | 273/1.5 R |
| 5,327,700 | 7/1994 | Sorenson et al. | 52/109 |
| 5,332,181 | 7/1994 | Schweizer et al. | 248/123.1 |
| 5,540,013 | 7/1996 | Diamond | 52/646 X |

FOREIGN PATENT DOCUMENTS

| | | | |
|---|---|---|---|
| 412926 | 12/1910 | France | 135/25.2 |

*Primary Examiner*—Wynn E. Wood
*Assistant Examiner*—W. Glenn Edwards
*Attorney, Agent, or Firm*—Heslin & Rothenberg, P.C.

[57] ABSTRACT

A joint mechanism having a movement between relative members about a center of rotation located at a point where a first line extends from one of the members intersects a second line extending from the opposite member is disclosed. Multiple joint mechanisms may be aligned together along with common lines being the axis of rotation of each joint mechanism to provide a concentric spherical joint mechanism. Concentric spherical joint mechanism may be used to assemble truss frame structures.

25 Claims, 7 Drawing Sheets

CONCENTRIC JOINT MECHANISM

BACKGROUND OF THE INVENTION

The present invention relates to joint mechanisms, and more particularly, to a spherical joint mechanism useable to provide spherical or circular motion about a particular point.

Various types of joints have been used to provide spherical motion. For example, a conventional ball joint where a convex hemispherical ball slides within a concave hemispherical socket may be used to provide spherical motion. In a ball joint spherical motion occurs about the center of the ball within the socket at the center of rotation. Spherical rotation does not occur about a point located outside of the ball joint thereby limiting spherical movement.

Other types of joints may also provide spherical motion. For example, Hooke, Cardan, and Universal joints are mechanisms whose links lie on the surface of a sphere, and the access of the pivots between links pass through the center of rotation. In these types of joints, the center of rotation may not be occupied by any part of the mechanism. However, access to the center of rotation may be obscured by the moving links and the center of rotation surrounded by the mechanism. With these types of joints, it is possible to have one or more joints share a common center of rotation. However, the interface between mechanisms often greatly reduces the range of motion of each joint.

Sliding spherical joints are also used to provide spherical motion about a point. In this type of joint, a mechanism slides on the inside of a hemispherically shaped track. Also, two crossed semicircular tracks may be used to carry a moving point wherein one track slides within the other track. This type of mechanism may not have unrestricted access to the center of rotation because the tracks extend around the center of rotation to provide a desired range of motion. Using this type of joint, multiple joints may also share a common center of rotation. However, the addition of each joint further reduces the available range of motion.

In addition to basic spherical joints, a number of joints have been developed for attaching a number of struts together. Beavers, U.S. Pat. No. 4,450,851, describes a "hub assembly" for a collapsible tent. DeLorme, U.S. Pat. No. 4,521,998, shows a "universal hub" for geodesic type structures. In both cases, the hub assemblies are primarily designed to connect struts together on the surface of a framework. The hubs only allow the struts to radiate outward roughly in a single plane (or on the surface of a cone).

Ventrella (U.S. Pat. No. 4,480,418) describes a joint for use in building "space grid structures" which allows struts to radiate out in all directions, but the spherical motion of the members is very limited.

In none of these assemblies are the centers of rotation of the attached struts concentric. This may cause two problems. First, compressive and tensile forces in the struts causes twisting moments on the joints, and the forces are not transmitted to the other struts as in an ideal truss. Second, in a controlled structure, such as a variable geometry truss robot, the motions of the mechanism in response to changing strut lengths is much more difficult to model.

It is therefore desirable to achieve a joint mechanism which provides a greater range of motion than in ball joints or Universal joints.

Moreover, it is also desirable to achieve a joint mechanism where the linkages obscure only a small section of an imaginary sphere located about the center of rotation of the joint mechanism in order to allow, among other things, that several joint mechanisms be used to share a common center of rotation.

It is also desirable to connect a plurality of joint mechanisms to comprise a concentric spherical joint mechanism having a common center of rotation wherein truss assemblies may be constructed using a plurality of concentric spherical joint mechanisms.

It is also desirable to provide a joint mechanism which provides for spherical or circular rotation about a center of rotation where it is undesirable or impossible to have portions of the mechanism located at the center of rotation.

It is also desirable to achieve a concentric spherical joint mechanism having multiple joint mechanisms thereon whereby the members are capable of radiating outward in all directions.

BRIEF DESCRIPTION OF THE DRAWINGS

The invention may best be understood in reference to the following detailed description when read in conjunction with the drawings in which.

SUMMARY OF THE INVENTION

Figure 1:
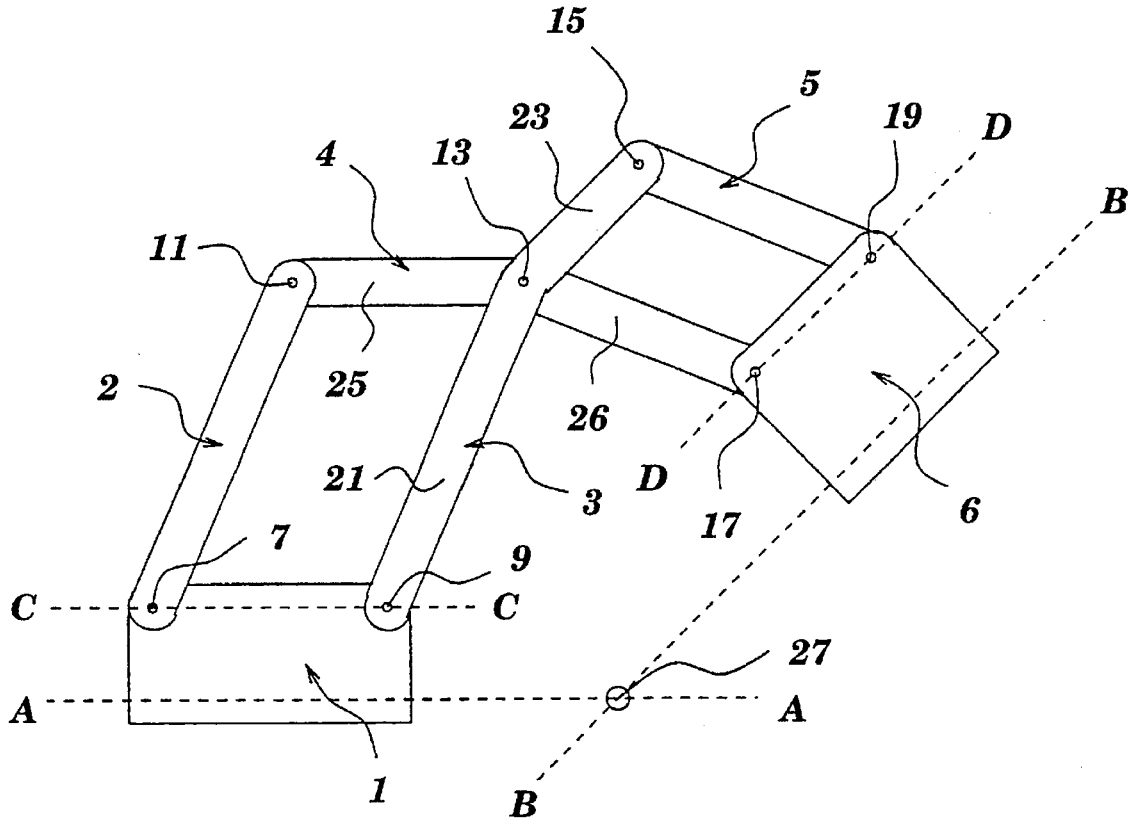
FIG. 1 depicts a joint mechanism capable of circular rotation about a central point and constructed in accordance with the principles of the present invention.

The joint mechanism is comprised of a plurality of members or links and may include first member; a second member being pivotally moveable relative to the first member about a first point; a third member having a primary section and a secondary section, a fourth member having a lead section and a trail section; a fifth member being pivotably moveable relative to the third member about a fifth point; a sixth member being pivotally moveable relative to the fourth member about a sixth point and being pivotally moveable relative to the fifth member about a seventh point. The primary section may have a length equal to the distance between a second point and a fourth point, and the secondary section may have a length equal to the distance between the fourth point and a fifth point wherein a line extending through the second and fourth points intersects a line extending between the fourth and fifth points at a second angle. The third member may be pivotally moveable relative to the first member about the second point. The lead section may have a length equal to the distance between a third point and the fourth point, and the trail section may have a length equal to the distance between the fourth point and the sixth point wherein a line extending through the third and fourth points intersects a line extending through the fourth and sixth points at a first angle. The fourth member may be pivotally moveable relative to the second member about the third point and pivotably moveable relative to the third member at the fourth point. The sine of the first angle may be equal to a first offset distance divided by the length of the trail section. The sine of the second angle may be equal to a second offset distance divided by a length of the primary section. Movement of the first member relative to the sixth member occurs about a center of rotation located at a point where a first line or axis extending from said first member intersects a second line or axis extending from the sixth member. The first line is located a distance equal to the first offset distance from a line extending between the first and second points. The second line being located at a distance equal to the second offset distance from a line extending between the sixth and seventh points.

The first angle and second angle form acute angles. The length of the secondary section may be equal to distance between the sixth point and seventh point. The length of the fifth member may be equal to the length of the trail section. The length of the lead section may be equal to the distance between the first point and the second point. The length of the second member may be equal to the length of the primary section.

The first line may be coincident with or parallel to the line extending between the first point and second point. The second line may be coincident with or parallel to the line extending between the sixth point and seventh point.

The first member may be rotatable about a line parallel to the first line or rotatable about the first line.

The first member, second member, third member, fourth member, fifth member, and sixth member may form a first joint mechanism. A second joint mechanism, having two degrees of freedom about a similar counter of rotation in structure to the first joint mechanism, may have a first line or axis thereof coincident with the second line or axis of the first joint mechanism. A third joint mechanism, also having two degrees of freedom about a center of rotation and similar in structure to the second joint mechanism and first Joint mechanism may have a first line thereof coincident with a second line of the second joint mechanism. The third joint mechanism may have a second line or axis thereof coincident with the first line or axis of the first joint mechanism thereby forming a first concentric spherical joint mechanism.

The concentric joint mechanism may further include a fourth joint mechanism having a first line or axis thereof coincident with the second line or axis of the third joint mechanism thereby forming a four axis concentric spherical joint mechanism.

The concentric spherical joint mechanism may be attached to a second concentric spherical joint mechanism by a link having a member coincident with one of said lines of said first concentric spherical joint mechanism.

Each of the lines of a first concentric spherical joint mechanism may include a linkage extending coincident with a first and second line thereof and each of the linkages may be attached to additional concentric spherical joint mechanisms, similar in structure to the first concentric spherical joint mechanism, to form a truss frame.

The joint mechanism may also be described as including a first member; a second member being pivotally attached to the first member at a first location; a third member having a primary section and a secondary section, the third member being pivotally attached to the first member at a second location, the secondary section extending from the primary section at a second angle; a fourth member having a lead section and a trail section extending from said lead section at a first angle, the fourth member being pivotally attached to the second member at a third location and attached to the third member at a fourth location; a fifth member being pivotably attached to the third member at a fifth location; a sixth member being pivotally attached to the fourth member at a sixth location and being pivotally attached to the fifth member at a seventh location. The sine of the first angle may be equal to a first offset distance divided by a length of the trail section and the length of the trail section is defined by the distance between the fourth location and the sixth location. The sine of the second angle may be equal to a second offset distance divided by a length of the primary section and the length of the primary section is defined by the distance between the second location and the fourth location. Movement of the first member relative to the sixth member occurs about a center of rotation located at a location where a first line or axis extending from said first member intersects a second line or axis extending from the sixth member. The first line may be located a distance equal to the first offset distance from a line extending between the first and second locations. The second line may be located at a distance equal to the second offset distance from a line extending between the sixth and seventh locations.

The first angle and second angle are acute angles. The length of the secondary section may be equal to the distance between the sixth point and the seventh point. The length of the fifth member may be equal to the distance between the fourth point and sixth point. The length of the second member may be equal to the distance between the second point and fourth point. The first line may be coincident with or parallel to the line extending between the first point and second point. The second line may be parallel to the line extending between the sixth point and seventh point. The first member may be rotatable about the first line to allow the joint mechanism two degrees of freedom.

DETAILED DESCRIPTION

In accordance with the principles of the present invention, a joint mechanism includes a first member 1, a second member 2, a third member 3, a fourth member 4, a fifth member 5, and a sixth member 6, as depicted in FIG. 1.

The second member 2 is pivotably attached to the first member 1 about a first point 7 and the third member 3 is pivotably attached to the first member about a second point 9. The second member 2 and third member 3 are rotatable relative to the first member 1 about the first point 7 and the second point 9, respectively. The first point 7 and the second point 9 are located upon imaginary line C—C. A fourth member 4 is pivotably attached to the second member 2 about a third point 11. Also, the fourth member 4 is pivotably attached to the third member 3 at a fourth point 13. The fourth member 4 pivotably rotates relative to the second member 2 and third member 3 about points 11 and 13, respectively. A fifth member 5 is pivotably attached to the third member 3 about a fifth point 15, and the fifth member 5 is rotatable relative to the third member 3 about the fifth point 15. A sixth member 6 is pivotably attached to the fourth member 4 at a sixth point 17. The sixth member 6 is also pivotably attached to the fifth member 5 at a seventh point 19. The sixth member is rotatable relative to the fourth member 4 and fifth member 5 about the sixth and seventh points, respectively. The sixth and seventh points, 17 and 19, are located within an imaginary line D—D.

An imaginary line having the fourth point 13 and fifth point 15 therein, intersects an imaginary line extending between the second point 9 and fourth point 13 at a second acute angle. The location of the third member 3 between the second point 9 and fourth point 13 forms a primary section 21 and the location of the third member 3 between the fourth point 13 and the fifth point 15 forms a secondary section 23. As is shown in FIG. 1, the third member 3 may comprise a bent bar where the secondary section 23 extends from the primary section 21 by a second acute angle.

An imaginary line extending between the third point 11 and fourth point 13 intersects an imaginary line extending between the fourth point 13 and sixth point 17 at a first acute angle. The location of the fourth member 4 between the third point 11 and fourth point 13 forms a lead section 25 and the location of the fourth member 4 between the fourth point 13 and the sixth point 17 forms a trail section 26. As shown in FIG. 1, the fourth member 4 may comprise a bent bar having a lead section 25 and a trail section 26, where the trail section extends from the lead section 25 at the first acute angle.

Under certain geometric conditions, the sixth member may rotate relative to the first member about a center of rotation 27 located on an imaginary line or axis A—A parallel to imaginary line C—C and located on an imaginary line or axis B—B parallel to an imaginary line D—D. Imaginary line or axis A—A is located at a first offset distance from imaginary line C—C, and imaginary line or axis B—B is located at a second offset distance from imaginary line D—D.

The dimensions and geometry necessary to achieve a center of rotation 27 located within imaginary line or axis A—A and imaginary line or axis B—B will now be described in reference to FIG. 5. The center of rotation 27 will be located along line A—A and along line B—B at the point of intersection when the sine of the first acute angle is equal to the first offset distance divided by the distance between the fourth point 13 and the sixth point 17; and the sine of the second acute angle is equal to the second offset distance divided by the distance between the second point 9 and fourth point 13. The distance between the second point 9 and fourth point 13 is equal to the distance between the first point 7 and third point 11. Also, the distance between the fourth point 13 and sixth point 17 is equal to the distance between the fifth point 15 and the seventh point 19. Also, the distance between the first point 7 and second point 9 is equal to the distance between the third point 11 and fourth point 13. Also, the distance between the sixth point 17 and seventh point 19 is equal to the distance between the fourth point 13 and fifth point 15. When the joint mechanism is formed of bar linkages as shown in FIG. 1 the distance between the first point and third point, 7, 11 may be the second member length and the distance between the fifth point 15 and seventh point 19 may be the fifth member 5 length.

The geometric conditions allowing for relative movement of the first and sixth members about a center of rotation may be represented as follows:

$$\sin f1 = O1/l1$$

$$\sin f2 = O2/l2,$$

where

O1=first offset distance

O2=second offset distance f1=first acute angle f2=second acute angle l1=distance between fourth point 13 and sixth point 17 l2=distance between second point 9 and fourth point 13

Figure 2:
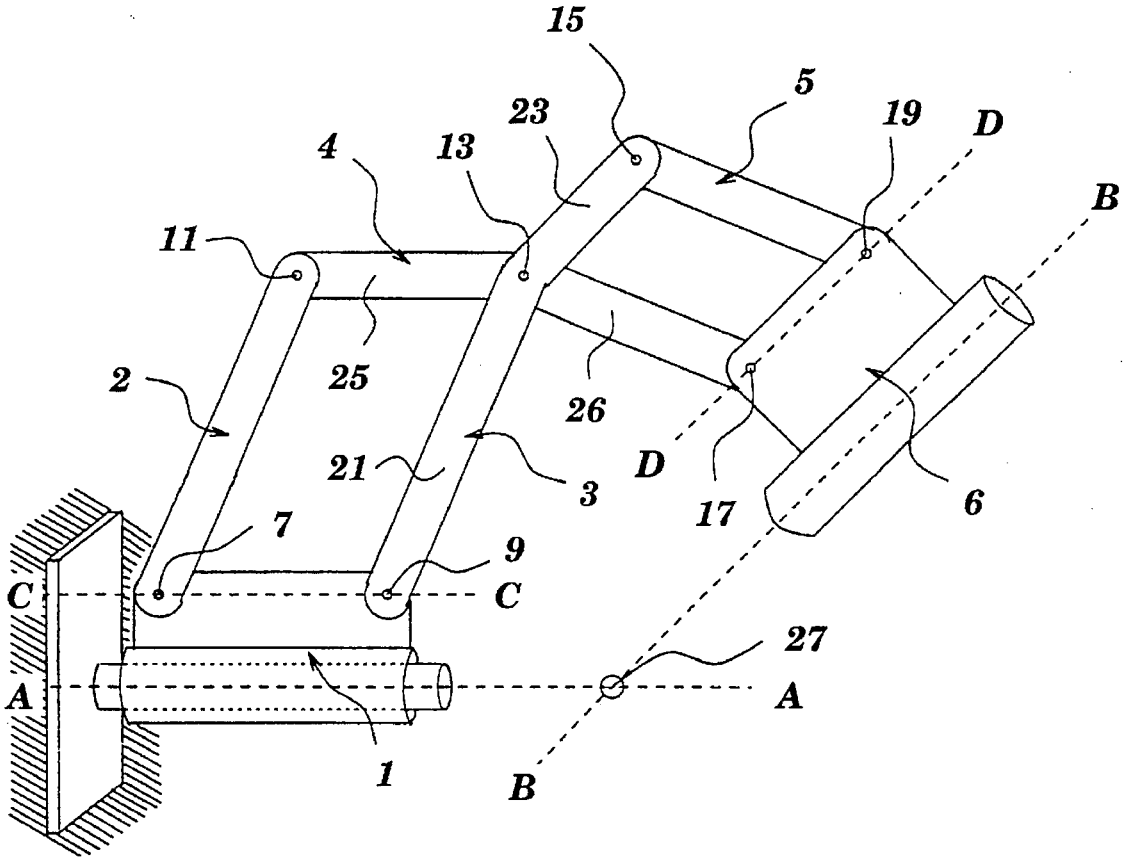
FIG. 2 depicts a joint mechanism constructed in accordance with the principles of the present invention and having two degrees of freedom about a center of rotation thereby being capable of spherical rotation about a central point.

Referring now to FIG. 2, a two degree of freedom or rotation of joint mechanism providing spherical movement around a center of rotation 27 is shown. The joint mechanism of FIG. 2 incorporates the structure of the joint mechanism depicted in FIG. 1, and which geometry is depicted in FIG. 5. However, the first member 1 is also rotatable about imaginary line or axis A—A which includes center of rotation 27 therein. Although not shown in FIG. 2, the sixth member 6 may include a structure allowing a piece to be aligned along axis B—B so that the structure may be rotatable about axis B—B and/or translatable along axis B—B.

Figure 3:
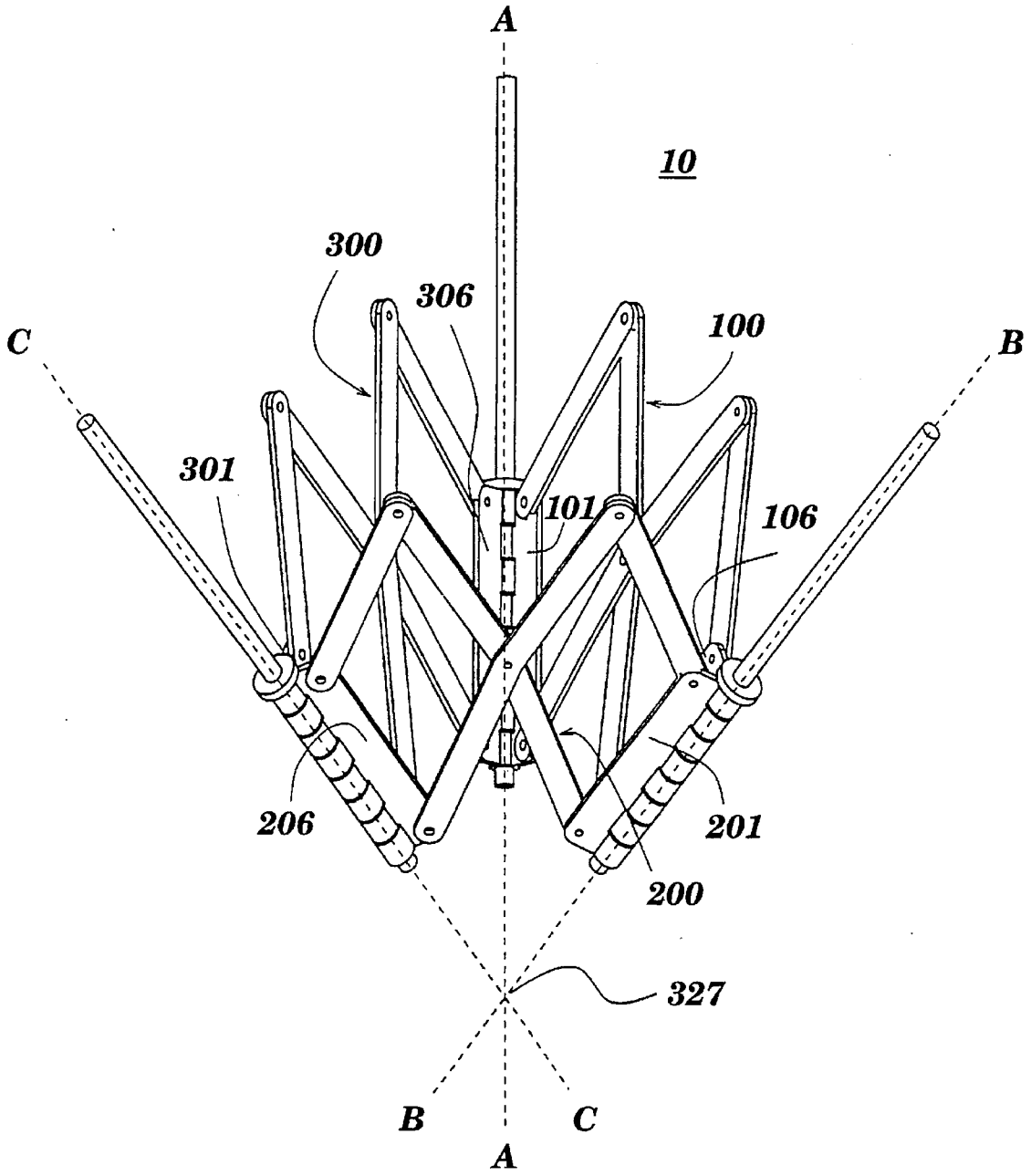
FIG. 3 depicts a concentric spherical joint mechanism having three joint mechanisms and three axes, each axis having a line extending therethrough coincident with a center of rotation thereof and comprised of a joint mechanism as depicted in FIG. 1.
Figure 5:
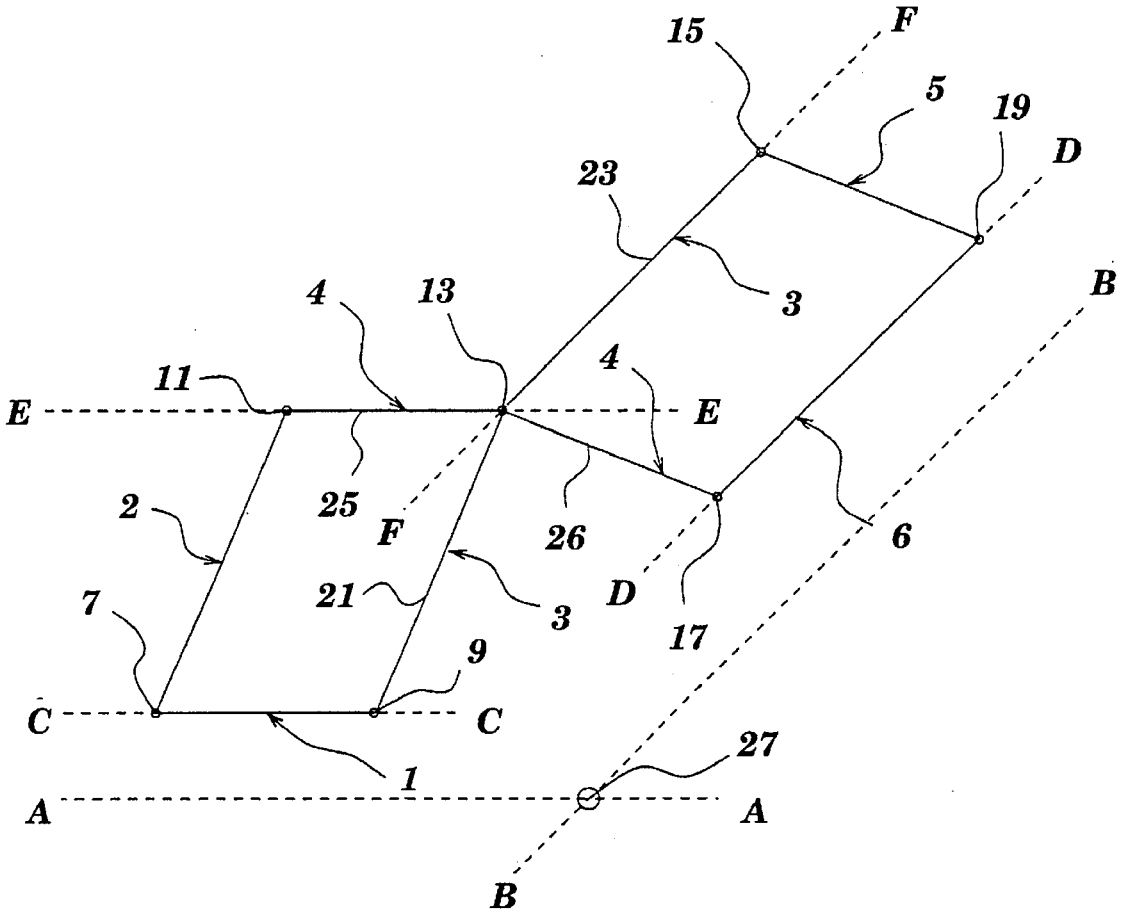
FIG. 5 depicts a schematic representation of the geometry of the joint mechanism depicted in FIGS. 1 and 2 a plurality of which form the concentric spherical joint mechanism of FIGS. 3 and 4.

Referring to FIG. 3, joint mechanisms such as those shown in FIGS. 1 and 2 which geometry is represented in FIG. 5, may be constructed to form multiple axis concentric spherical joint mechanisms. As shown in FIG. 3, a three axis concentric spherical joint mechanism is shown. A first joint mechanism 100, is connected to a second joint mechanism 200, and a third joint mechanism 300. The second joint mechanism 200 and third spherical joint mechanism 300 are also connected to one another. The first member 101 of the first joint mechanism 100 is rotatable about imaginary line or axis A—A and the sixth member 106 thereof is rotatable about the imaginary line or axis B—B so that the center of rotation 327 is the point of intersection of imaginary line A—A and B—B. The first member 201 of the second joint mechanism 200 is also rotatable about imaginary line B—B while the sixth member 206 thereof is rotatable about imaginary line or axis C—C such that the point of intersection of imaginary lines B—B and C—C is the center of rotation of the second joint mechanism 200. The first member 301 of the third joint mechanism 300 is rotatable about imaginary line or axis C—C and the sixth member 306 thereof is rotatable about imaginary line or axis A—A such that the center of rotation of the third joint mechanism is the point of intersection of imaginary line A—A and imaginary line C—C. Since the first, second and third joint mechanisms, 100, 200, 300, are each similar in configuration to the joint mechanism depicted in FIG. 2 which geometry is shown in FIG. 5, the point of intersection of lines A—A, B—B and C—C will occur at one point constituting the center of rotation 327. The center of rotation 327 constitutes the center of rotation of the three axis spherical joint mechanism shown in FIG. 3.

Figure 4:
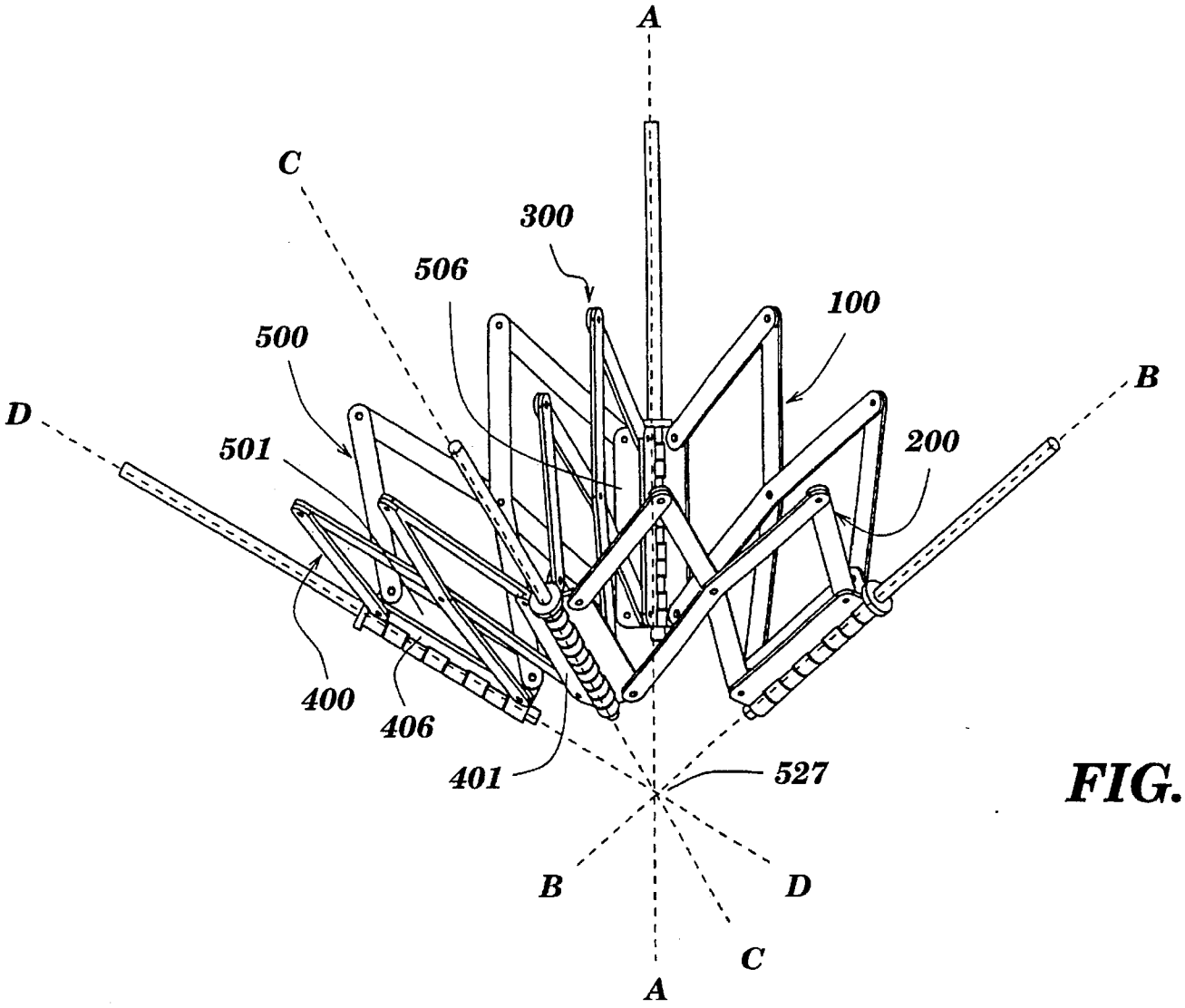
FIG. 4 depicts a concentric spherical joint mechanism having four joint mechanisms with two degrees of freedom and four axes, each axis having a line extending therethrough coincident with a center of rotation of a joint mechanism and comprised of a joint mechanism as depicted in FIG. 1.

In FIG. 4, a four axis concentric spherical joint mechanism is shown. The four axis concentric spherical joint mechanism incorporates the three axis concentric spherical joint mechanism depicted in FIG. 3 with the addition of two joint mechanisms similar to that depicted in FIG. 2 which geometry is shown in FIG. 5. A fourth joint mechanism 400 contains its first member 401 which is rotatable about imaginary line or axis C—C and a sixth member 406 rotatable about imaginary line or axis D—D. The center of rotation of the fourth joint mechanism 400 occurs at the intersection of lines D—D and C—C at center of rotation 527. A fifth joint mechanism 500 has its first member 501 about imaginary line or axis D—D and its sixth member 506 rotatable about imaginary line or axis A—A so that the center of rotation of the fifth joint mechanism 500 occurs at the intersection of lines A—A and D—D also at center of rotation 527. The four axis concentric spherical joint therefore has the center of rotation of each of the first, second, third, fourth, and fifth joint mechanisms about center of rotation at point 527. As shown in FIG. 3 and 4, to allow the concentric spherical joints to be rotated about imaginary lines or axis A—A, B—B, C—C, and D—D pins or rods may be aligned along each of the aforementioned imaginary lines or axis to allow rotation of the first and sixth members of each of the joint mechanisms thereabout.

Figure 6:
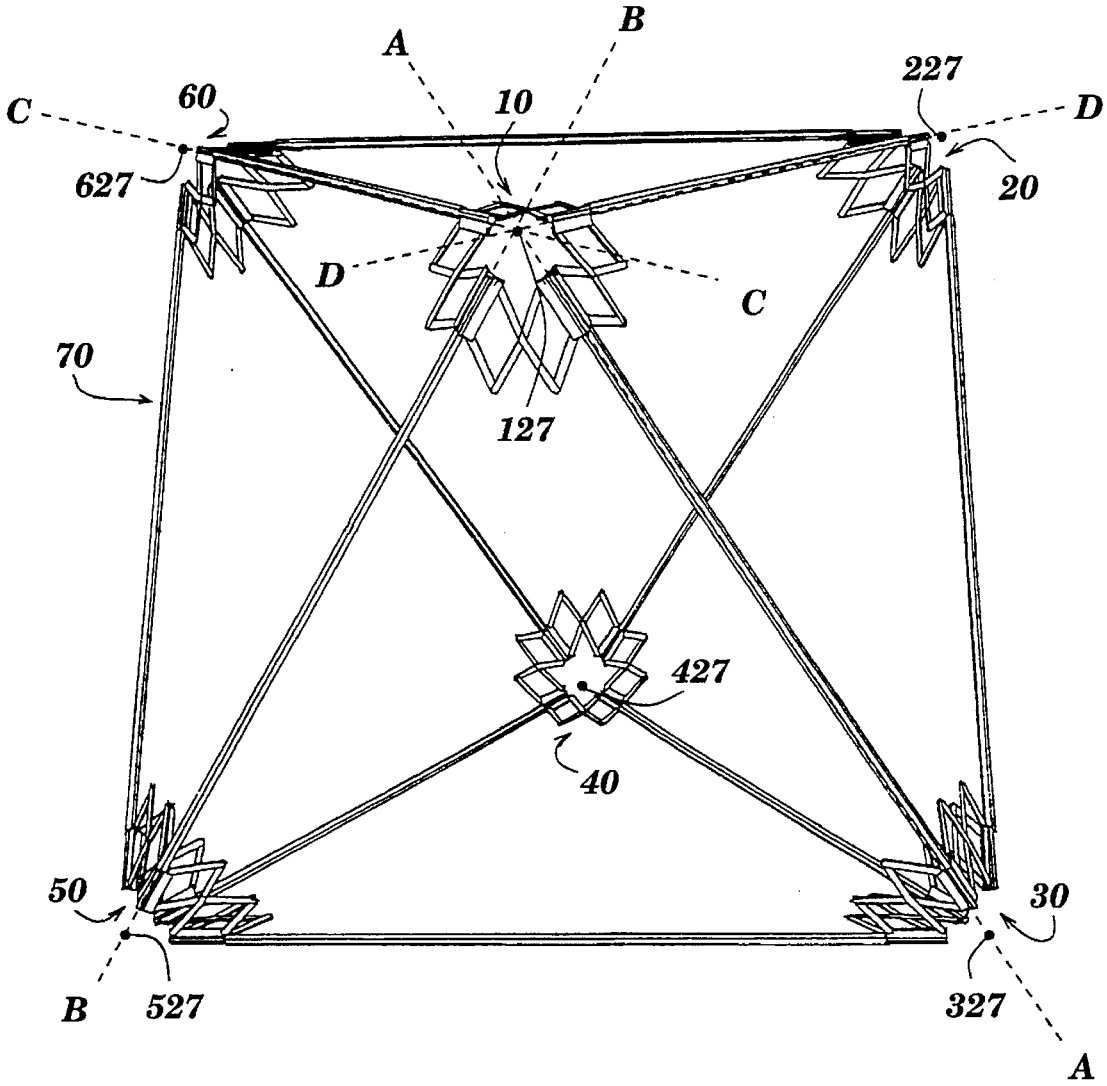
FIG. 6 depicts an actuated truss structure utilizing multiple concentric spherical joint mechanisms each comprised of two degrees of freedom joint mechanisms as depicted in FIG. 2 and constructed in accordance with the principles of the present invention.

Referring now to FIG. 6, a truss mechanism utilizing an alternative four axis concentric spherical joint mechanism is shown and an actuated truss frame structure using multiple concentric spherical joint mechanisms is shown. The truss assembly contains a first four axis spherical joint mechanism 10, a second four axis concentric spherical joint mechanism 20, a third four axis concentric spherical joint mechanism 30, a fourth four axis concentric spherical joint mechanism 40, a fifth four axis concentric spherical joint mechanism 50, and a sixth four axis concentric spherical joint mechanism 60. Each of the aforementioned four axis concentric joint mechanisms comprise spherical joint mechanisms 10, 20, 30, 40, 50, 60 comprised of joint mechanisms having geometries such as that shown in FIG. 5. In addition, each concentric spherical joint mechanism is similar to the concentric spherical joint mechanism 10 of FIG. 4 with the removal of the third joint mechanism 300 (FIG. 4) therefrom. Each concentric spherical joint mechanism of FIG. 6 contains a plurality of joint mechanism such as that shown in FIG. 2, which geometry is indicated in FIG. 5 and described supra. Each spherical joint mechanism 10, 20, 30, 40, 50, 60 has a corresponding center of rotation 127, 227, 327, 427, 527, 627, respectively. Linkages such as linkage 70 may be aligned with each of the axis of rotation of the joint mechanisms comprising each of the concentric spherical joint mechanisms and connect each concentric spherical joint mechanism to another concentric spherical joint mechanism to form the truss frame. Although not shown in the drawings concentric spherical joint mechanisms of more than four axis may be used to construct truss frame structures and the invention is not limited thereto.

Figure 7:
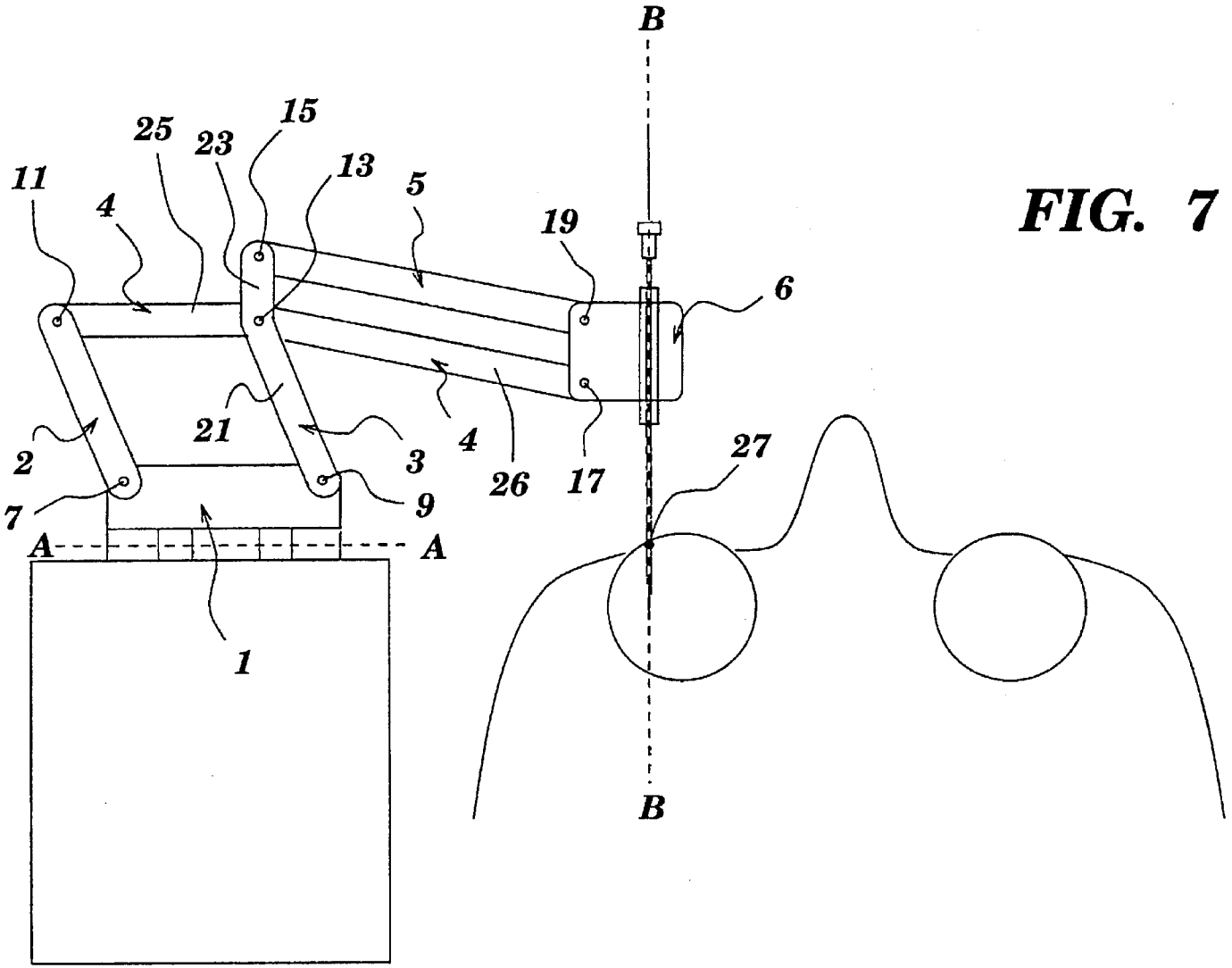
FIG. 7 depicts a joint mechanism similar to that shown in FIGS. 1 and 5 used to perform ophthalmic surgery having a center of rotation being the point of entry to a patient's eye.

Referring to FIG. 7, one application of the joint mechanism constructed in accordance with the principles of the present invention is shown using a joint mechanism similar to the structure of the joint mechanism depicted in FIG. 2 which geometry is shown in FIG. 5. A thin surgical tool may be insertable through a hollow needle aligned along axis B—B for use in performing ophthalmic surgery whereby the center of rotation 27 along the intersection of axis A—A and B—B is on the surface of a patient's eye so that a minimal incision is placed within the patient's eye to perform such surgery.

Although the invention has been described in connection with the embodiments depicted herein, it would be apparent to one of ordinary skill in the art that various modifications may be made to the invention without departing in any way from the scope of the invention as defined within the following claims.

I claim:

1. A joint mechanism comprising:

a first member;

a second member being pivotally moveable relative to the first member about a first point;

a third member having a primary section and a secondary section, the primary section having a length equal to the distance between a second point and a fourth point, and the secondary section having a length equal to the distance between the fourth point and a fifth point wherein a line extending through the second and fourth points intersects a line extending between the fourth and fifth points at a second angle, the third member being pivotally moveable relative to the first member about the second point;

a fourth member having a lead section and a trail section the lead section having a length equal to the distance between a third point and the fourth point, and the trail section having a length equal to the distance between the fourth point and a sixth point wherein a line extending through the third and fourth points intersects a line extending through the fourth and sixth points at a first angle, the fourth member being pivotally moveable relative to the second member about the third point and pivotably moveable relative to the third member at the fourth point;

a fifth member being pivotably moveable relative to the third member about the fifth point;

a sixth member being pivotally moveable relative to the fourth member about the sixth point and being pivotally moveable relative to the fifth member about a seventh point;

the sine of the first angle being equal to a first offset distance divided by a length of the trail section, wherein the length of the trail section is defined by the distance between the fourth point and the sixth point;

the sine of the second angle being equal to a second offset distance divided by a length of the primary section, wherein the length of the primary section is defined by the distance between the second point and the fourth point;

wherein movement of the first member relative to the sixth member occurs about a center of rotation located at a point where a first line extending from said first member intersects a second line extending from the sixth member, the first line being located a distance equal to the first offset distance from a line extending between the first and second points, the second line being located at a distance equal to the second offset distance from a line extending between the sixth and seventh points.

2. The joint mechanism of claim 1 wherein said first angle and said second angle are acute angles.

3. The joint mechanism of claim 1 wherein the length of the secondary section is equal to distance between the sixth point and seventh point.

4. The joint mechanism of claim 3 wherein the length of the fifth member is equal to the length of the trail section.

5. The joint mechanism of claim 3 wherein the length of the lead section is equal to the distance between the first point and the second point.

6. The joint mechanism of claim 5 wherein the length of the second member is equal to the length of the primary section.

7. The joint mechanism of claim 4 wherein the first line is parallel to the line extending between the first point and second point.

8. The joint mechanism of claim 6 wherein the second line is parallel to the line extending between the sixth point and seventh point.

9. The joint mechanism of claim 8 wherein the first member is rotatable about a line parallel to the first line.

10. The joint mechanism of claim 8 wherein the first member is rotatable about the first line.

11. The joint mechanism of claim 8 wherein said first member, second member, third member, fourth member, fifth member, and sixth member form a first joint mechanism and further comprising a second joint mechanism, said second joint mechanism being similar in structure to said first joint mechanism and having a first line thereof coincident with the second line of the first spherical joint mechanism.

12. The joint mechanism of claim 11 further comprising a third joint mechanism being similar in structure to said first joint mechanism and having a first line thereof coincident with a second line of the second joint mechanism.

13. The joint mechanism of claim 12 wherein the third joint mechanism has a second line thereof coincident with the first line of the first joint mechanism thereby forming a first concentric spherical joint mechanism.

14. The joint mechanism of claim 12 further comprising a fourth joint mechanism having a first line thereof coincident with the second line of the third joint mechanism thereby forming a first concentric spherical joint mechanism.

15. The joint mechanism of claim 13 or 14 wherein said first concentric spherical joint is attached to a second concentric spherical joint by a link having a member coincident with one of said lines of said first concentric spherical joint mechanism.

16. The joint mechanism of claim 15 wherein each of said lines of said first concentric spherical joint mechanism comprises a linkage extending coincident therewith, each of said linkages being attached to additional concentric spherical joint mechanisms to form a truss frame.

17. A joint mechanism comprising:

a first member;

a second member being pivotally attached to the first member at a first location;

a third member having a primary section and a secondary section, the third member being pivotally attached to the first member at a second location, the secondary section extending from the primary section at a second angle;

a fourth member having a lead section and a trail section extending from said lead section at a first angle, the fourth member being pivotally attached to the second member at a third location and attached to the third member at a fourth location;

a fifth member being pivotably attached to the third member at a fifth location;

a sixth member being pivotally attached to the fourth member at a sixth location and being pivotally attached to the fifth member at a seventh location;

the sine of the first angle being equal to a first offset distance divided by a length of the trail section, wherein the length of the trail section is defined by the distance between the fourth location and the sixth location;

the sine of the second angle being equal to a second offset distance divided by a length of the primary section, wherein the length of the primary section is defined by the distance between the second location and the fourth location;

wherein movement of the first member relative to the sixth member occurs about a center of rotation located at a location where a first line extending from said first member intersects a second line extending from the sixth member, the first line being located a distance equal to the first offset distance from a line extending between the first and second locations, the second line being located at a distance equal to the second offset distance from a line extending between the sixth and seventh locations.

18. A joint mechanism comprising:

a first point and a second point, the first and second points being oriented on a first member;

a third point, the first point and the third point being located on a second member, the second member being pivotably moveable relative to the first member about the first point;

a fourth point and a fifth point, the second point, fourth point and fifth point being located on a third member;

a sixth point, the third point, fourth point and sixth point being located on a fourth member, the fourth member being pivotably moveable relative to the second member about a third point, the fourth member being pivotably moveable relative to the third member about a fourth point;

a seventh point, the seventh point and fifth point being oriented on a fifth member, the fifth member being pivotably moveable relative to the third member about the fifth point;

the sixth point and said seventh point being oriented on a sixth member, the sixth member being pivotably moveable relative to the fourth member about the sixth point, the sixth member being pivotably moveable relative to the fifth member about a seventh point;

the sine of a first angle located where a line extending through the third and fourth points intersects a line extending between the fourth and sixth points being equal to a first offset distance divided by a distance between the fourth point and the sixth point;

the sine of a second angle located where a line extending through the second and fourth points intersects a line extending through the fourth and fifth points being equal to a second offset distance divided by a distance between the second point and the fourth point; and wherein movement of the first member relative to the sixth member occurs about a center of rotation located at a point where a first line extending from said first member intersects a second line extending from the sixth member, the first line being located at a distance equal to the first offset distance from a line extending between the first and second points, the second line being located at a distance equal to the second offset distance from a line extending between the sixth and seventh points.

19. The joint mechanism of claim 18 wherein said first angle and said second angle are acute angles.

20. The joint mechanism of claim 19 wherein the length of the secondary section is equal to the distance between the sixth point and seventh point.

21. The joint mechanism of claim 20 wherein the length of the fifth member is equal to the distance between the fourth point and sixth point.

22. The joint mechanism of claim 21 wherein the length of the second member is equal to the distance between the second point and fourth point.

23. The joint mechanism of claim 22 wherein the first line is parallel to the line extending between the first point and second point.

24. The joint mechanism of claim 23 wherein the second line is parallel to the line extending between the sixth point and seventh point.

25. The joint mechanism of claim 24 wherein the first member is rotatable about the first line.

* * * * *